United States Patent [19]

Tischer et al.

[11] Patent Number: 4,522,575

[45] Date of Patent: Jun. 11, 1985

[54] SCROLL MACHINE USING DISCHARGE PRESSURE FOR AXIAL SEALING

[75] Inventors: James C. Tischer, La Crescent, Minn.; Robert E. Utter, Genoa, Wis.

[73] Assignee: American Standard Inc., New York, N.Y.

[21] Appl. No.: 581,849

[22] Filed: Feb. 21, 1984

[51] Int. Cl.[3] ..... F04C 18/04; F04C 29/00

[52] U.S. Cl. ..... 418/55; 418/57

[58] Field of Search ..... 418/55, 57

[56] References Cited

U.S. PATENT DOCUMENTS

| | | | |
|---|---|---|---|
| 3,600,114 | 8/1971 | Dvorak et al. | 418/55 |
| 3,874,827 | 4/1975 | Young | 418/55 |
| 3,884,599 | 5/1975 | Young et al. | 418/55 |
| 3,924,977 | 12/1975 | McCullough | 418/55 |
| 3,994,633 | 12/1976 | Shaffer | 418/5 |
| 4,065,279 | 12/1977 | McCullough | 62/510 |
| 4,343,599 | 8/1982 | Kousokabe | 418/55 |
| 4,365,941 | 12/1982 | Tojo et al. | 417/372 |
| 4,415,317 | 11/1983 | Butterworth | 418/55 |

FOREIGN PATENT DOCUMENTS 55-137384 3/1980 Japan .

55-148994 11/1980 Japan .

*Primary Examiner*—John J. Vrablik

*Attorney, Agent, or Firm*—Ronald M. Anderson; Carl M. Lewis; William J. Beres

[57] ABSTRACT

A scroll compressor in which a fluid compressed by the machine is applied to one side of an orbiting scroll plate to provide an axial sealing force directed toward an opposing stationary scroll plate. Intermeshed involute wrap elements on facing surfaces of the two scroll plates define pockets in which the fluid is compressed as a motor drives one of the plates in an orbital motion relative to the other. Both the motor and scroll plates are enclosed in a hermetic shell. The volume enclosed by the shell is divided by the driven scroll plate and an internal supporting frame into one part that is at suction pressure and another part at discharge pressure. A seal extending from the frame abuts the back side of the driven scroll plate and defines the relative areas of that plate which are exposed to suction and discharge pressure. The net force resulting from these pressures acts on the orbiting plates, biasing it toward the stationary plate to provide axial sealing between the involute wrap elements and the scroll plates.

12 Claims, 3 Drawing Figures

SCROLL MACHINE USING DISCHARGE PRESSURE FOR AXIAL SEALING

DESCRIPTION

1. Technical Field

This invention generally pertains to a scroll machine, and specifically, to a scroll compressor housed in a hermetic shell, wherein discharge pressure and suction pressure applied to the scroll plates are used to achieve a desired axial thrust.

2. Background Art

In a scroll machine, fluid is displaced in pockets defined by the flank surfaces of complementary intermeshed involute wrap elements that are connected to facing parallel plates. The parallel plates are caused to orbit in a fixed angular motion relative to each other, so that the pockets of fluid are displaced about the spiral path defined between the intermeshed involutes, from an inlet to a point of discharge.

Depending upon the configuration of the involute wrap elements and the direction of relative orbital motion, a scroll machine may function as an expander (vacuum pump), a compressor, or a liquid pump. When used as an expander, the pockets of fluid moving through the machine originate near the axial center of the involutes and expand in volume as they move outwardly around the involute wraps. Conversely, in a scroll compressor, pockets of fluid move from the radially outer ends of the involutes, around the wraps, toward a center discharge port, experiencing a substantial reduction in volume in the process. In a liquid pump application of the scroll machine, each of the involute wrap elements makes only a single loop about its axis, such that the pockets of liquid between the involutes are not subjected to a significant change in volume as they move from inlet to discharge.

When a scroll compressor is enclosed in a hermetic shell, compressed fluid is normally conveyed from a discharge port in the center of the stationary scroll plate to a discharge connection on the shell by means of an internal tube or passage. Suction fluid conventionally enters the hermetic shell at a port disposed in the opposite end of the shell and is directed through an annular gap between the rotor and stator of an electric motor (to provide cooling for the motor). Most of the volume enclosed by the shell is thus at suction pressure.

One of the two scroll plates in a scroll machine is usually stationary, being connected to a supporting framework. The other scroll plate is connected to a rotating crank disposed on the end of a drive shaft so that it is caused to orbit relative to the stationary scroll plate. Fluid trapped in pockets defined by line contacts between flank surfaces of wrap elements attached to the plates is compressed by the orbital motion.

Typically, a design clearance is maintained between the tips of the wrap elements and the opposite interwrap surfaces of the facing scroll plate, by either a thrust bearing or by fluid pressure, opposing the axial thrust of the fluid being compressed. The thrust bearing may comprise either a grooved annular ring, or ball bearings, supported by the framework. Examples of these two approaches for providing axial thrust are shown in U.S. Pat. Nos. 4,065,279 and 4,415,317, respectively.

In lieu of a thrust bearing, a chamber disposed behind the orbiting scroll plate may be pressurized with fluid at either discharge pressure or a pressure intermediate suction and discharge by means of passages that extend through the orbiting scroll plate. This scheme is shown in U.S. Pat. Nos. 3,600,114 and 4,365,941. An externally supplied pressure may also be used for this purpose, as disclosed in U.S. Pat. No. 3,994,633. Using pressure to bias the scroll plates in the axial direction for sealing purposes as compared to using a thrust bearing is advantageous in that it substantially reduces frictional losses, provided that the axial force is not excessive. These losses may be significant. When using a thrust bearing, static friction and the resulting torque required of the motor are greater at start-up, than the dynamic friction which is present during steady-state operation of the compressor. Providing an axial thrust using pressure supplied by the fluid being compressed remedies this problem because at start-up, the pressure supplied is substantially lower than when the machine reaches it normal operating speed.

As noted in the above-cited U.S. Pat. No. 4,365,941, the net force acting on the orbiting scroll plate in the axial direction should be maintained to achieve an equilibrium condition. This condition is difficult to obtain when the magnitude of the pressure is affected by the size and radial location of the passages through the scroll plate. It is not easy to calculate the net force on the plate, since the magnitude of the pressure is not well known. If the pressure is too low, the force will not be great enough to insure an adequate axial seal; and if too great, the efficiency of the machine is decreased due to excess friction.

It is therefore an object of this invention to provide a scroll machine in which the net axial force is easily determined. It is a further object of this invention to control the axial force applied to the orbiting scroll plate by proper selection of the area of the scroll plate subjected to discharge pressure relative to the area subjected to suction pressure.

A still further object is to use a seal that abuts the back of the orbiting scroll plate to determine the ratio of the area subjected to discharge pressure and the area subjected to suction pressure, and thereby the axial force which acts on the plate.

Yet a further object is to minimize losses due to friction between the involute wrap elements and the scroll plates by providing a net axial force that does not excessively bias the orbiting scroll plate toward the stationary plate.

These and other objects of the present invention will be apparent by reference to the attached drawings and to the description of the preferred embodiments, which follows hereinbelow.

SUMMARY OF THE INVENTION

A scroll compressor is described, comprising two generally parallel scroll plates, one stationary and the other orbiting. The facing surface of each plate has an involute wrap element attached thereon in intermeshed relationship with the wrap element of the other plate. The wrap elements each define a radially inner and a radially outer flank surface of similar spiral shape about an axis. Contacting flank surfaces of the intermeshed wrap elements define one or more pockets of fluid which are compressed by the relative orbital motion of the plates.

Means are included for driving the orbiting scroll plate in fixed angular relationship relative to the stationary plate. These two scroll plates are enclosed within a hermetic shell that includes an inlet for admitting suction fluid and an outlet for discharging compressed fluid. A framework is provided in sealing contact with the inner surface of the hermetic shell and is operative to divide the total volume enclosed by the shell into a part that is at suction pressure and another part that is at discharge pressure. The outwardly facing surface of one of the scroll plates is exposed to both suction and discharge pressure, the relative area of the plate that is subjected to each pressure being determined by the line along which a seal extending from the framework abuts the scroll plate. The diameter of the seal is selected to achieve a desired net axial thrust on the scroll plate.

DESCRIPTION OF THE PREFERRED EMBODIMENTS

Figure 1:
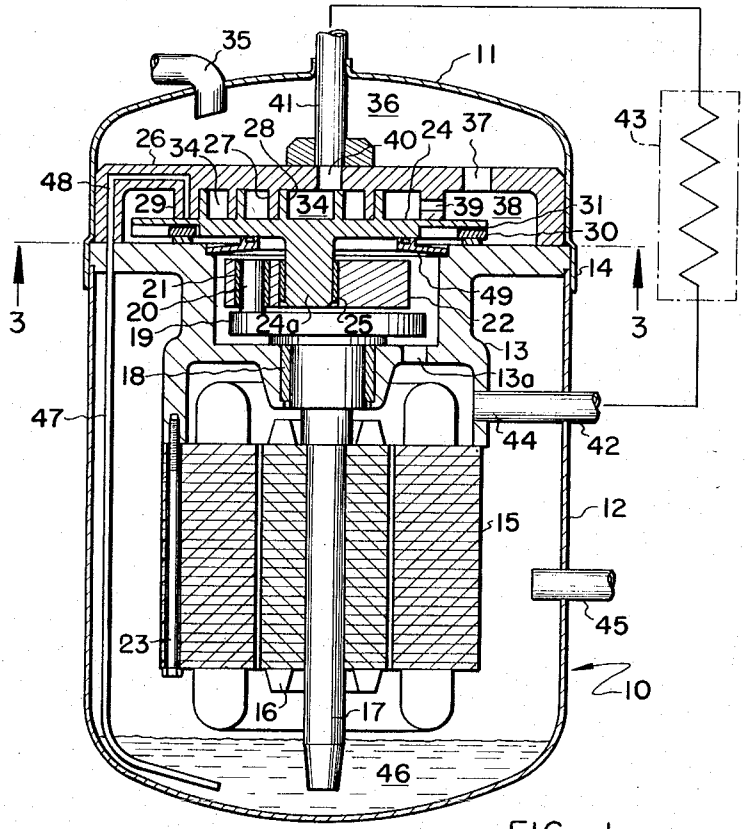
FIG. 1 is a sectional view of the first embodiment of the subject invention showing a scroll machine in which the discharge fluid is conveyed from a port in a stationary scroll plate to an enclosed volume behind the other scroll plate through a passage that is external the hermetic shell.

With reference to FIG. 1, a scroll compressor including the subject invention is generally represented by reference numeral 10. Scroll compressor 10 comprises a hermetic shell which includes an upper portion 11 and a lower portion 12. The radially outer edge of a supporting frame 13 is sealingly fixed between the upper shell 11 and lower shell 12 at a point where a lip 14 on the upper shell 11 overlaps and is sealingly connected to the lower shell 12 by suitable means, such as by welding.

Frame 13 is operative to support a motor comprising a stator assembly 15 and a rotor 16, which are generally centered within the lower hermetic shell 12. A plurality of long bolts 23 are threaded into frame 13 at intervals around stator 15, thus connecting the stator to the frame.. Rotor 16 is press fit or otherwise suitably attached to a drive shaft 17, which in turn is rotatably supported within frame 13 by means of drive shaft bearing 18. The upper end of drive shaft 17 includes a crank 19, having a crank pin 20 eccentrically disposed relative to the longitudinal axis of the drive shaft. Crank pin 20 is seated within a bearing 21 disposed within a swing link 22. Functionally, swing link 22 provides a radially compliant linkage to connect crank pin 20 to an orbiting scroll plate 24 by means of a drive stub **24*a* that extends from the back surface of scroll plate 24. Drive stub 24*a* is seated within a bearing 25 disposed within the swing link 22. The axial center of drive stub 24*a* describes a circular orbit as crank 19 is rotated by drive shaft 17. The benefits and details of operation of the radially compliant linkage provided by swing link 22 are disclosed in U.S. Pat. No. 3,924,977, and are well known to those skilled in the art. The effect of the driving mechanism comprising drive shaft 17, crank 19, and swing link 22, is simply to translate the rotational motion of the drive shaft into the orbital motion of the driven scroll plate 24**.

A stationary scroll plate 26 is connected to the frame 13, and is disposed in generally parallel facing relationship to the orbiting scroll plate 24. An involute wrap element 27 is attached to the facing surface of stationary scroll plate 26, extending toward the opposing surface of the orbiting scroll plate 24. Likewise, on the facing surface of orbiting scroll plate 24 is attached a complementary involute wrap element 28 that extends to the opposing surface of stationary scroll plate 26, and is intermeshed with wrap element 27. Stationary scroll plate 26 further includes a thrust ring 29 which also extends to the opposing surface of the orbiting scroll plate 24 and generally encloses the wrap elements 27 and 28. Thrust ring 29 carries the axial thrust between the scroll plates in the area around the circumference of the wrap elements 27 and 28. The tip of thrust ring 29 may include a series of radial and axial grooves formed therein (not shown) for distributing lubricant around the tip where it abuts against the orbiting scroll plate 24. The lubrication of this portion of compressor 10 will be discussed in further detail hereinbelow.

Figure 3:
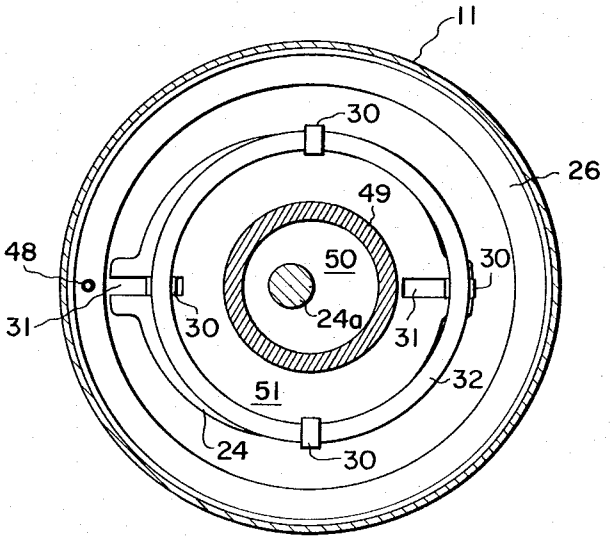
FIG. 3 is a cross-sectional view taken along section lines 3—3 of FIG. 1, showing the relative areas of the orbiting scroll plate, that are subjected to suction and discharge pressure, as determined by the point of contact of the thrust seal.

A generally conventional Oldham coupling comprising four sliding blocks 30 that engage slots 31 is provided to insure that scroll plate 24 orbits in fixed angular relationship to the stationary scroll plate 26. Further details of the Oldham coupling are shown in FIG. 3. Those skilled in the art will recognize how two slots 31 formed at diametrically opposite sides of the orbiting scroll plate 24, and two slots 31 formed in opposite sides of frame 13 (along a line orthogonal to a line connecting the slots 31 in scroll plate 24) interact with sliding blocks 30 that are connected to a coupling ring 32, to constrain the motion of orbiting plate 24 in fixed angular relationship to the stationary scroll plate 26.

The radially inner and outer flank surfaces of wrap elements 27 and 28 contact each other at two or more points to define one or more pockets of fluid which are compressed by the orbital motion of scroll plate 24. These fluid pockets 34 change volume as they move around the involute wrap elements 27 and 28, thereby compressing the fluid contained therein. Fluid to be compressed enters the hermetic shell 11 through a suction port 35 that is in fluid communication with a suction chamber 36 enclosed by the upper shell 11. The fluid passes through a plurality of suction openings 37 and into an annulus chamber 38 disposed radially exterior to the thrust ring 29. Suction fluid then passes through a plurality of passages 39, thereby reaching the radially outer ends of the wrap elements 27 and 28. The motion of the orbiting scroll plate 24 causes the fluid to be trapped and compressed in pockets 34, and once compressed, to be discharged through an opening 40 disposed approximately at the center of stationary scroll plate 26. The compressed fluid passes through a discharge tube 41, exiting the upper hermetic shell 11 and returning to the lower hermetic shell through discharge line 42.

As shown in FIG. 1, the discharge fluid in line 41 passes through an optional heat exchanger 43 which serves to cool the discharge fluid before it re-enters the lower hermetic shell 12. Optional heat exchanger 43 is placed in heat exchange relationship with ambient air or with some other cooling medium, e.g., cooling water. Alternatively, if cooling of the discharge fluid is not required, discharge line 41 may connect directly with line 42 without passing through heat exchanger 43. The requirement for cooling the discharge fluid using the heat exchanger 43 depends on the maximum operating temperature which the motor housed within shell 12 may withstand. Since motors rated to withstand relatively high operating temperatures are commercially available, external heat exchanger 43 may be unnecessary.

Compressed fluid entering the lower hermetic shell 12 through line 42 passes through a return port connecting tube 44 that extends into the upper portion of the stator windings 15. Compressed fluid is thus forced to flow through the annulus separating the stator 15 and rotor 16, thereby cooling the motor. A passage 13*a* through frame 13 insures that the radially inner portion of the underside of orbiting scroll plate 24 is also exposed to discharge fluid pressure. Finally, the compressed fluid is discharged from lower hermetic shell 12 through a discharge port 45.

The lower portion of hermetic shell 12 includes an oil reservoir 46. During operation of compressor 10, the volume enclosed by hermetic shell 12 and separated from the volume enclosed by the upper hermetic shell 11 by frame 13 is at discharge pressure, and therefore, oil in reservoir 46 is exposed to this relatively higher pressure. An oil delivery tube 47 extends from below the surface of the oil in reservoir 46 through frame 13 and into oil passage 48, which is in fluid communication with the radial and circumferential grooves in the tip of thrust ring 29. The tip of thrust ring 29 is at suction pressure, which may be 200–300 p.s.i. less than the discharge pressure in the lower hermetic shell 12. This differential pressure forces oil to flow up the delivery tube 47 and to be distributed around the tip of thrust ring 29. To prevent excessive oil flow, delivery line 47 must have either an interior capillary bore or an orifice restriction. Oil thus delivered to the tip of thrust ring 29 serves to lubricate it as the tip slides across the upper portion of the orbiting scroll plate 24. Lubricant is also drawn into the pockets 34 along with the suction fluid entering through passages 39. This oil entrained with the suction fluid serves to increase the operating efficiency of compressor 10 by improving the effectiveness of the seal between the tips and flank surfaces of involute wrap elements 29 and 28 at their point of contact with each other and with the opposing surfaces of the scroll plate 24 and 26. The entrained oil is eventually separated from the compressed fluid after returning to the compressor through line 42 and flows back into the reservoir 46.

Further lubrication of bearings 18, 21 and 25 may be provided by a centrifugal oil pump of a conventional design, forcing oil up through an internal bore (not shown) in crankshaft 17. This type of centrifugal pump is well known to those skilled in the art; a further discussion of the lubrication system used in compressor 10 should not be necessary to properly disclose the subject invention.

An important element of this invention is the thrust seal 49 which extends radially inward from frame 13, in abutting contact with the underside of orbiting scroll plate 24. Thrust seal 49 contacts the underside of the orbiting scroll plate 24 along a circular line that serves to separate the lower surface of the scroll plate into two areas, one exposed to discharge, and the other to suction pressure. FIG. 3 shows this in greater detail. The area 50 that is radially inside the point where thrust seal 49 contacts scroll plate 24 is subjected to discharge pressure, and area 51 that is radially outside this point of contact is exposed to suction pressure. Since scroll plate 24 is in orbital motion, the point of contact of thrust seal 49 is continually changing. Nevertheless, the relative size of areas 50 and 51 remains substantially constant. By properly selecting the radius of thrust seal 49 in contact with orbiting scroll plate 24, a designer may determine the net axial thrust applied to the orbiting scroll plate 24 during steady-state operation of compressor 10. This net axial force should provide adequate sealing between the tips of wrap elements 27 and 29 where they contact the opposing scroll plates 24 and 26. An excessive net axial thrust merely increases the friction between the sliding surfaces, thereby reducing the operating efficiency of the compressor 10. Since the discharge pressure and suction pressure are easily determined design parameters, the net axial thrust on orbiting scroll plate 24 is relatively easy to determine as a function of areas 50 and 51. This simplifies the designer's task in providing the proper sealing force.

Figure 2:
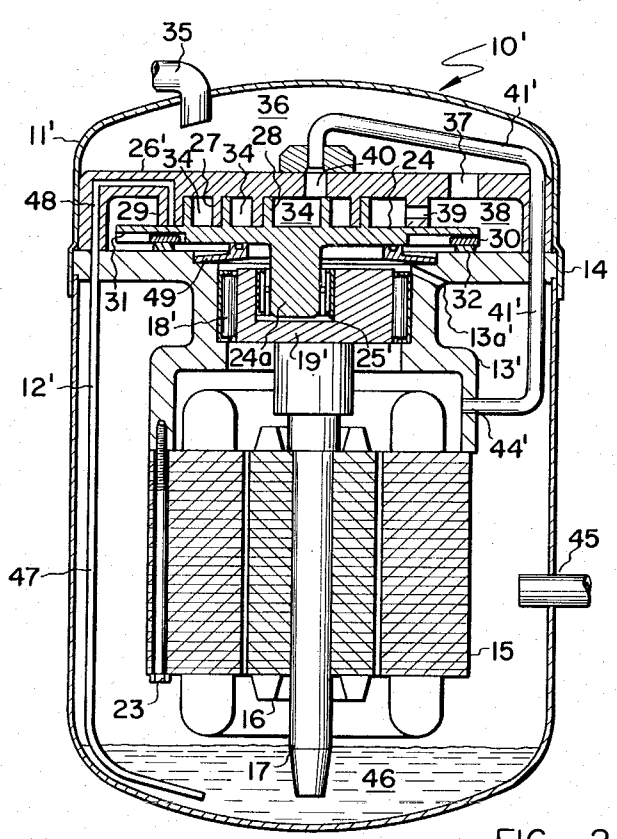
FIG. 2 is a sectional view of the second embodiment of the subject invention in which the discharge fluid is conveyed from a port in the stationary scroll plate to the volume behind the other scroll plate through a passage completely disposed within the hermetic shell.

Turning now to FIG. 2, a second embodiment of a scroll compressor including the subject invention is shown, wherein the same reference numerals are used to identify elements of the compressor which are equivalent to those in the first embodiment, and prime reference numerals are used to identify elements having the same function, but having a different design. The second embodiment of the scroll compressor is generally denoted by reference numeral 10', and differs from the first embodiment in that compressed fluid exiting the discharge opening 40 within stationary scroll plate 26' passes through a discharge line 41' that is completely enclosed within the hermetic shell, thereby eliminating an additional opening within each part of the shell. Thus, in the second embodiment, the hermetic shell comprises an upper shell 11' and a lower shell 12'. In addition, discharge line 41' extends through the stationary scroll 26 and frame 13' adjacent their peripheral edge, where they abut against the inside of hermetic shells 11' and 12'.

For the purpose of illustrating that the subject invention is equally applicable to a scroll compressor using a direct-drive rather than the compliant linkage provided by a swing link 22, the second embodiment of the invention shown in FIG. 2 is of the direct-drive design. It includes a crankshaft 17 with crank 19' seated within a roller bearing 18' that is centered within frame 13'. Crank 19' does not have a crank pin 20, but instead directly connects to the drive stud 24*a* on orbiting scroll plate 24. Roller bearing 25' permits the rotation of crank 19' about drive stud 24*a*. Since bearing 25' is eccentrically disposed relative to the longitudinal axis of drive shaft 17, the rotation of the drive shaft is directly translated into an orbital motion of the scroll plate 24 without the radially compliant linkage of the first embodiment shown in FIG. 1. It should be understood, however, that the direct-drive mechanism shown in FIG. 2 could be applied to the first embodiment shown in FIG. 1, wherein the compressed fluid is discharged through an external line 41 and 42. Conversely, the radially compliant linkage shown in FIG. 1 could also be applied to the second embodiment of FIG. 2 wherein compressed fluid is discharged through internal line 41'. The application of this invention to a scroll compressor is therefore independent of the type of drive mechanism, directly or radially compliant.

The second embodiment of the invention otherwise operates generally as previously disclosed for the first embodiment. It also includes a thrust seal 49 to separate the lower surface area of the orbiting scroll plate 24 into the portion 50 which is at discharge pressure and the other portion 51 which is at suction pressure. FIG. 3 serves to explain this feature of the invention equally well for the second embodiment shown in FIG. 2, even though it is a cross-sectional view derived from the first embodiment shown in FIG. 1. The net axial thrust on the orbiting scroll plate 24 is thus determined in the second embodiment in exactly the same fashion as it was in the first embodiment. In all other respects, the first and second embodiments operate in substantially the same manner.

It should be understood that while the present invention has been described with respect to the preferred embodiment, modifications to those embodiments which will be readily apparent to those skilled in the art lie within the scope of the present invention as defined in the claims which follow.

We claim:

1. A scroll compressor comprising a. two generally parallel scroll plates, one stationary, the other driven in an orbital motion, the facing surface of each having an involute wrap element attached thereon in intermeshed relationship with the wrap element of the other, said wrap elements each defining a radially inner and a radially outer flank surface of similar spiral shape about an axis, contacting flank surfaces of the intermeshed wrap elements defining one or more pockets of fluid compressed by the relative orbital motion of the plates;

b. driving means applied to the orbiting scroll plate, for causing it to move in fixed angular orbital relationship relative to the stationary scroll plate;

c. a hermetic shell sealingly enclosing the two scroll plates, and including an inlet for admitting suction fluid and an outlet for discharging compressed fluid;

d. a framework extending around the inner surface of the hermetic shell in sealing relationship therewith, said framework being operative to divide the total volume enclosed by the hermetic shell into a suction volume at suction pressure and a discharge volume at discharge pressure, the outwardly facing surface of the orbiting scroll plate being directly exposed to fluid at both suction and discharge pressure; and e. an annular thrust balancing seal that extends from the framework to the outwardly facing surface of the orbiting scroll plate, in sealing contact therewith, whereby the relative area of the orbiting scroll plate exposed to fluid at discharge pressure compared to the area exposed to fluid at suction pressure is controlled by the diameter of the thrust balancing seal where it contacts the orbiting scroll plate, to achieve a desired net axial thrust on the orbiting scroll plate toward the stationary scroll plate by balancing the resulting applied forces on the orbiting scroll plate.

2. The scroll compressor of claim 1 wherein the framework is operative to support at least one of the scroll plates within the hermetic shell.

3. The scroll compressor of claim 1 wherein the stationary scroll plate includes a discharge port disposed near its center, in fluid communication with the discharge volume, and wherein the radially outer ends of the wrap elements are in fluid communication with the suction volume.

4. The scroll compressor of claim 3 further comprising a passage connecting the discharge port with the discharge volume, said passage being fully enclosed by the hermetic shell and extending from the discharge port through an opening in the framework.

5. The scroll compressor of claim 3 further comprising a passage that connects the discharge port to the discharge volume, said passage passing through the hermetic shell.

6. The scroll compressor of claim 1 wherein the driving means include an electric motor comprising a stator and a rotor and wherein the compressed fluid is circulated through an annular space between the rotor and stator before being discharged from the outlet in the hermetic shell.

7. A scroll compressor comprising a. a stationary scroll plate and a scroll plate driven in an orbital motion, having generally parallel facing surfaces, each with an attached involute wrap element in intermeshed relationship with the wrap element of the other, said wrap elements each defining a radially inner and a radially outer flank surface of similar spiral shape about an axis, contacting flank surfaces of the intermeshed wrap elements defining one or more pockets of fluid compressed by the relative orbital motion of the plates, with a wrap inlet adjacent the radially outer ends of the wrap elements, and a discharge port disposed in the stationary scroll plate, near its axial center;

b. driving means connected to the orbiting scroll plate, for driving it in fixed angular orbital relationship relative to the stationary scroll plate, said means including an electric motor;

c. a hermetic shell sealingly enclosing the two scroll plates and the driving means, and including an inlet for admitting suction fluid and an outlet for discharging compressed fluid;

d. means for partitioning the total volume enclosed by the hermetic shell into two separate volumes, one at suction pressure and the other at discharge pressure, said means comprising in combination, framework and the outwardly facing sides of the scroll plates, said framework being operative to support the scroll plates within the shell, and including a flange that sealingly engages the inner surface of the hermetic shell, the outward facing surface of the orbiting scroll plate being directly exposed to fluid at both suction and discharge pressure; and e. an annular thrust balancing seal that extends radially inward from the framework to the outwardly facing surface of the orbiting scroll plate, in sealing contact therewith, and which is biased toward the orbiting scroll plate by the differential between the discharge and suction pressures, increasing the effectiveness of the seal, whereby the relative area of the orbiting scroll plate exposed to fluid at discharge pressure compared to the area exposed to fluid at suction pressure is controlled by the diameter of the thrust balancing seal where it contacts the orbiting scroll plate, and that diameter is selected to achieve a desired net axial thrust on the orbiting scroll plate toward the stationary scroll plate by balancing the resulting applied forces on the orbiting scroll plate.

8. The scroll compressor of claim 7 wherein the framework is further operative to support the driving means within the hermetic shell.

9. The scroll compressor of claim 7 wherein the discharge port is in fluid communication with the discharge volume, and wherein the wrap element inlet is in fluid communication with the suction volume.

10. The scroll compressor of claim 9 further comprising a passage connecting the discharge port with the discharge volume, said passage being enclosed by the hermetic shell and extending from the discharge port through an opening in the framework.

11. The scroll compressor of claim 9 further comprising a passage that connects the discharge port to the discharge volume, said passage passing through the hermetic shell.

12. The scroll compressor of claim 7 wherein the electric motor includes a stator and a rotor and wherein the compressed fluid is circulated through an annular space between the rotor and stator within the discharge volume before the compressed fluid is discharged from the outlet in the hermetic shell.

* * * * *